US009828977B2

(12) United States Patent
Huang

(10) Patent No.: US 9,828,977 B2
(45) Date of Patent: Nov. 28, 2017

(54) RESPONSIVE THREE-DIMENSIONAL SURFACE CONTROLLER

(71) Applicant: Li-Da Huang, Austin, TX (US)

(72) Inventor: Li-Da Huang, Austin, TX (US)

( * ) Notice: Subject to any disclaimer, the term of this patent is extended or adjusted under 35 U.S.C. 154(b) by 637 days.

(21) Appl. No.: 14/324,237

(22) Filed: Jul. 7, 2014

(65) Prior Publication Data

US 2015/0013317 A1 Jan. 15, 2015

Related U.S. Application Data

(60) Provisional application No. 61/845,910, filed on Jul. 12, 2013.

(51) Int. Cl.

| | |
|---|---|
| ***A47C 27/08*** | (2006.01) |
| ***F04B 1/34*** | (2006.01) |
| ***F04B 9/109*** | (2006.01) |
| ***A47C 27/10*** | (2006.01) |

(52) U.S. Cl.
CPC ..... *F04B 1/34* (2013.01); *A47C 27/10* (2013.01); *F04B 9/109* (2013.01)

(58) Field of Classification Search
CPC ..... A61G 7/057; A61G 7/00; A47C 27/08
USPC ..... 5/713, 710, 706, 933
See application file for complete search history.

(56) References Cited

U.S. PATENT DOCUMENTS 3,822,425 A * 7/1974 Scales ..... A61G 7/05769 5/699
5,446,933 A * 9/1995 Gabelhouse ..... A47C 23/002 5/670

* cited by examiner

*Primary Examiner* — Fredrick Conley
(74) *Attorney, Agent, or Firm* — Che-Yang Chen; Law Offices of Scott Warmuth

(57) ABSTRACT

A system to generate and control a three-dimensional (3D) surface may include a surface supported by a plurality of actuating units, a control center, and a common media tank. The control center may include a movement control assembly that has a plurality of movement control unit, and each movement control unit is configured to control the movement of a corresponding actuating unit. In one embodiment, a predetermined amount of medium, such as air or liquid, is arranged in each actuating unit. The surface can be actually considered an array of small pieces divided from the surface, and supported and actuated by the actuating units. Since the control of the surface is through the control of every single piece thereof, the control of the surface would be more precise if the surface can be divided into more pieces.

9 Claims, 6 Drawing Sheets

RESPONSIVE THREE-DIMENSIONAL SURFACE CONTROLLER

CROSS-REFERENCE TO RELATED APPLICATIONS

This application claims priority under 35 U.S.C. §119(e) to U.S. Provisional Patent Application Ser. No. 61/845,910, filed on Jul. 12, 2013, the entire contents of which are hereby incorporated by reference.

FIELD OF THE INVENTION

The present invention relates to a method and apparatus for controlling and generating a three-dimensional (3D) surface, and more particularly to a method and apparatus using one or more multiple reciprocal moving parts to generate and control the 3D surface.

BACKGROUND OF THE INVENTION

Fluid power is the transmission of forces and motions using a confined and pressurized fluid to convert the forces/motions to a more useable form and distribute them. In hydraulics, the fluid is a liquid (usually oil), whereas pneumatics uses a gas (usually compressed air). Comparing with mechanical and electrical power, fluid power systems easily produce a linear motion using hydraulic or pneumatic cylinders, whereas electrical and mechanical methods usually must use a mechanical device to convert a rotational motion to a linear motion.

Fluid power systems can generally transmit equivalent power within a much smaller space than mechanical or electrical drives can, especially when extremely high force or torque is required. Fluid power systems also offer simple and effective control of direction, speed, force, and torque using simple control valves. For example, hydraulic systems can be finely controlled for precision motion applications because the oil has high modulus.

Furthermore, the fluid power system is also famous for its compactness and flexibility. Fluid power cylinders are relatively small and light for their weight and flexible hoses allows power to be snaked around corners, over joints and through tubes leading to compact packaging without sacrificing high force and high power. Due to the advantages stated above, the fluid system has been widely used and developed in the field of medical devices, including the body supporting equipment that can not only support the body weight, but also generate responsive changes according to the body posture.

U.S. Pat. No. 6,009,580 to Caminade et al. discloses a method and apparatus for supporting a body element. The apparatus includes at least one support device with at least one closed or controlled-release chamber, a filling device and an emptying means device for filling said chamber with a filling fluid and emptying the fluid from the chamber, and a distance-measurement device for measuring the distance between a top face and a bottom face of the chamber. More specifically, Caminade measures the penetration corresponding to a predetermined float line to determine when to fill or empty the chamber, as shown in FIG. 1. However, the float line for each person would be different and the penetration is actually difficult to measure. Thus, if the timing to fill or empty the chamber is inappropriate, the person being supported may feel uncomfortable.

U.S. Pat. No. 6,763,541 to Mahoney et al. discloses an air bed having a pump and a relief valve operably connected with a control box. The control box is capable of being programmed or receiving scripted information from a media file such that timed pressure changes may be made in the air bed by operation of the pump and the relief valve. These changes are synchronized with a message being played by a media player. Thus, the air bed interacts with a person lying on the bed. However, Mahoney seems to emphasize on how the user can interact with the air bed, but does not particularly teach how to precisely control the timing to fill or empty the bladder(s) that is used to support the person.

U.S. Pat. No. 8,090,478 to Skinner et al. discloses an apparatus for supporting a patient that includes a patient support surface, at least one fluid containing bladder and a pressure control assembly. The at least one bladder is positioned to provide support for the patient when the patient is bearing on the patient support surface for at least a portion of the patient support surface. The pressure control assembly is operably coupled with the at least one bladder and regulates the fluid pressure within the at least one bladder. The pressure control assembly includes a programmable controller which is programmed to monitor sensed pressure values of the fluid pressure within the at least one bladder and adjust the fluid pressure within the at least one bladder. The controller is programmed wherein an acceptable range of pressure values is defined and the controller initiates adjustment of the fluid pressure within the at least one bladder when a sensed value is located outside the acceptable range of pressure and a time period following the sensing of the sensed value has elapsed without the fluid pressure within the at least one bladder returning to the acceptable range of pressure, where the time period has a variable length. However, the supporting apparatus includes a limited number of bladders that is used to provide the support of the patient, and the control of the bladder is merely through the pressure control assembly. Like Caminade and Mahoney, Skinner does not suggest how to precisely control the pressure of the bladders in the supporting apparatus.

Therefore, there remains a need for a new and improved system to precisely control a three-dimensional surface to overcome the problems stated above.

SUMMARY OF THE INVENTION

It is an object of the present invention to provide a system and apparatus to precisely control a three-dimensional (3D) surface.

It is another object of the present invention to provide a system and apparatus to precisely control a 3D surface utilizing a fluid power system that includes an array of actuating units to support and actuate the 3D surface.

It is a further object of the present invention to utilize a fluid power system including an array of actuating units to precisely control a 3D surface, and the actuating units are controlled by a control center with a plurality of movement control units and control valves.

It is still a further object of the present invention to use a reciprocal movement slab (RMB) to control the movement control units to further control the actuating units and the 3D surface.

In one aspect, a system to generate and control a three-dimensional (3D) surface may include a surface supported by a plurality of actuating units, a control center, and a common media tank. The control center may include a movement control assembly that has a plurality of movement control unit, and each movement control unit is configured to control the movement of a corresponding actuating unit. In one embodiment, a predetermined amount of medium, such as air or liquid, is arranged in each actuating unit.

In another embodiment, the movement control unit may include a driving unit, a first media container and a second media container. In one embodiment, the first media container is connected with the actuating unit, while the second media container is connected with the control center. A reciprocal moving slab (RMS) is disposed nearly at the center of the driving unit to control the movement thereof and further control the movement of at least a portion of the surface by controlling the medium movement in the actuating unit.

In a further embodiment, the control center may further include a plurality of control vales to control the medium flow. For example, when the reciprocal movement slab moves toward the first media container, the driving unit is driven to push out the medium in the first media container to the corresponding actuating unit to push up a portion of the surface located on top of the actuating unit through the control of one or more control valves.

On the other hand, when the reciprocal movement slab moves towards the second media container, a suction force is created to pull at least a portion of the medium out from the corresponding actuating unit to further lower down the portion of the surface through the control of one or more control valves.

In another aspect, the control center may include an pressure control device; a reciprocal moving slab (RMS) control device and a valve control device. The pressure control device may also include a pressure sensing unit and a pressure control unit in each of the actuating unit. In one embodiment, the pressure sensing unit and pressure control unit can also be arranged and disposed near the control valves to monitor the pressure when the medium is transported. The RMS control device is configured to control the movement of the reciprocal moving slab, for example, towards either the first media container or the second media container. Whether the reciprocal moving slab should move towards the first or second media container can be determined mostly by the desired movement of the surface. The amount of the medium in the actuating units, the pressure in the actuating units, the control valves, etc. can also be the factors to affect the movement of the reciprocal moving slab.

The valve control device is configured to control the valves. The valve control device can receive a command from a central processor regarding the movement of at least a portion of the surface, and the valve control device is used to adjust the valve position of each control valve as discussed above to either allow the medium pass through the valve to the actuating unit or direct the medium to the common medium tank.

The control center may also include a data storage device, a memory, a data receiving device and a central processor, which may be operatively communicate with the pressure control device, the RMB control device, the valve control device and the data receiving device to manage and control the movement of at least a portion of the surface.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

As previously discussed, the fluid power system has been widely used and developed in the field of medical devices, including the body supporting equipment that can not only support the body weight, but also generate responsive changes according to the body posture. Even though the control of the fluid power system has been developed in the body supporting equipment, the control thereof is not precise. Therefore, there remains a need for a new and improved system and apparatus to overcome the control problem of the body supporting equipment. Namely, an improved system and apparatus to precisely control a three-dimensional (3D) surface is needed.

Figure 1:
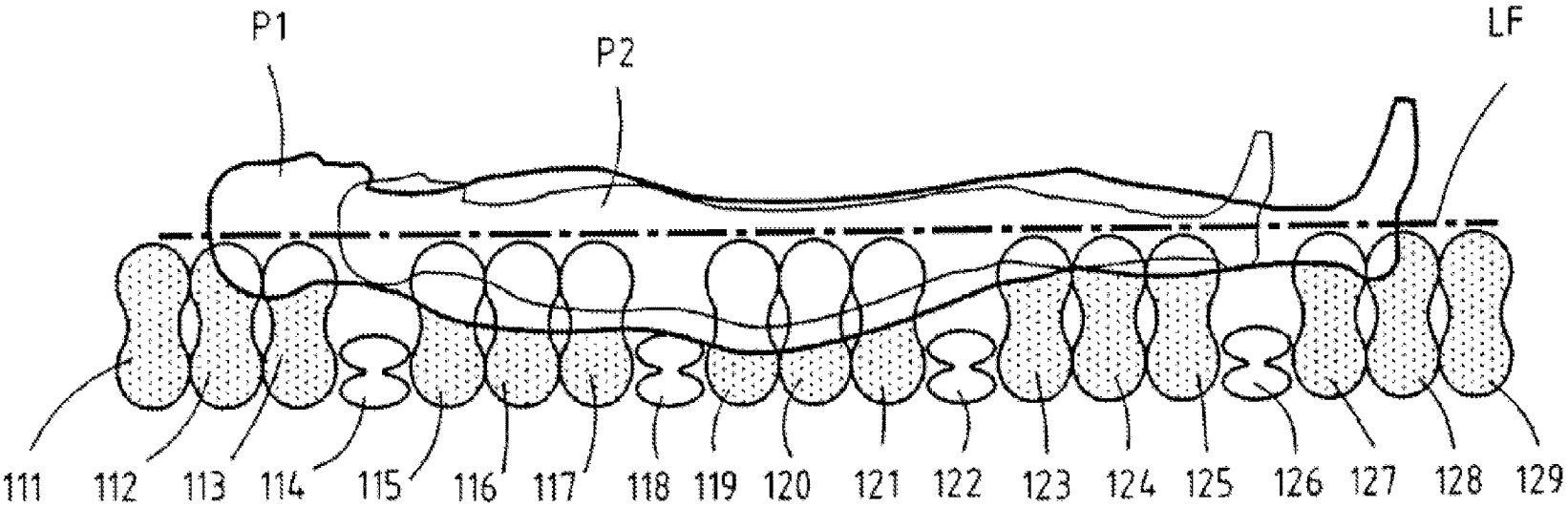
FIG. 1 (Prior Art)
FIG. 1 illustrates a prior art of a method and apparatus for supporting a body element.
Figure 2:
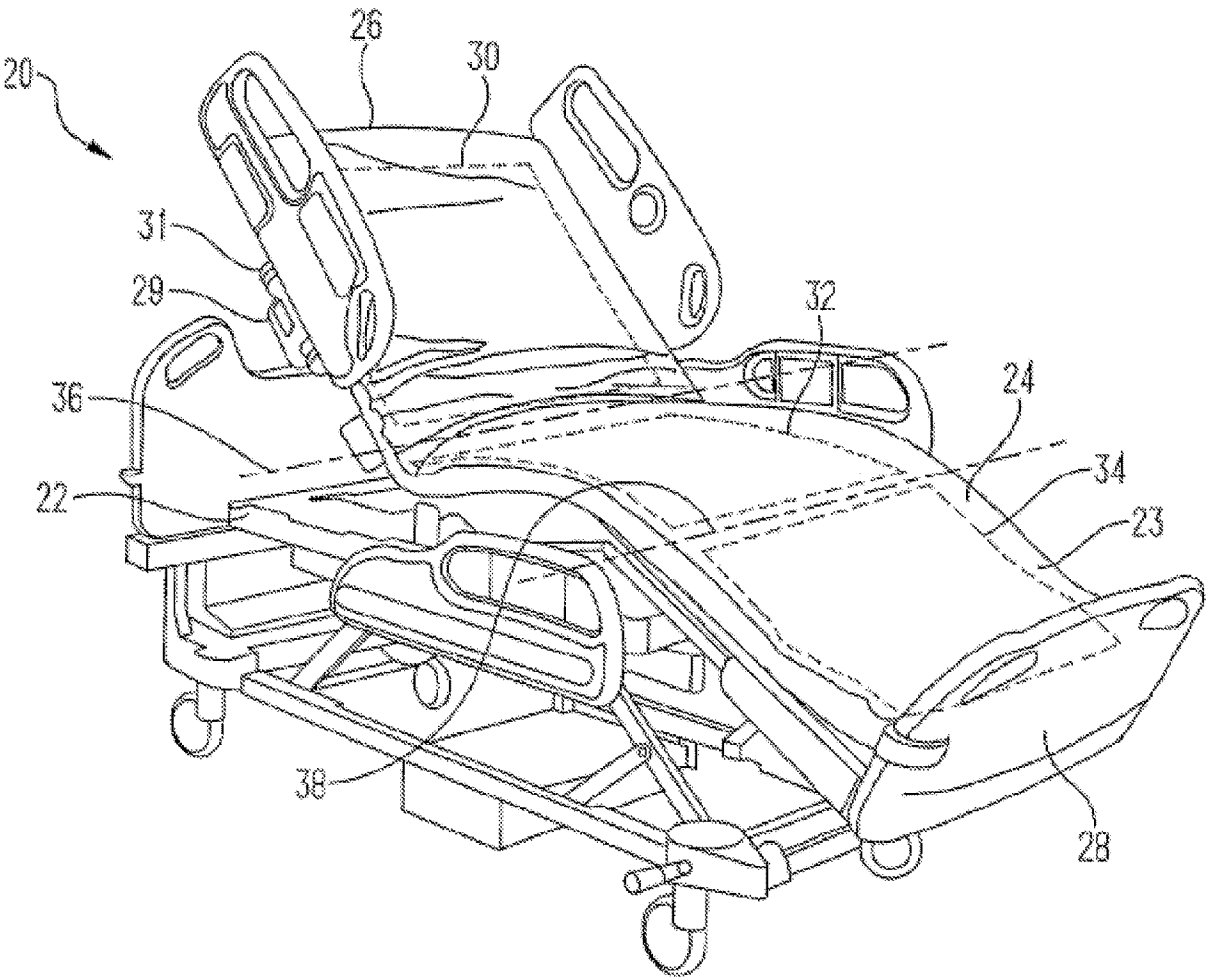
FIG. 2 (Prior Art)
FIG. 2 illustrates a prior art of an apparatus used for supporting a patient.
Figure 2A:
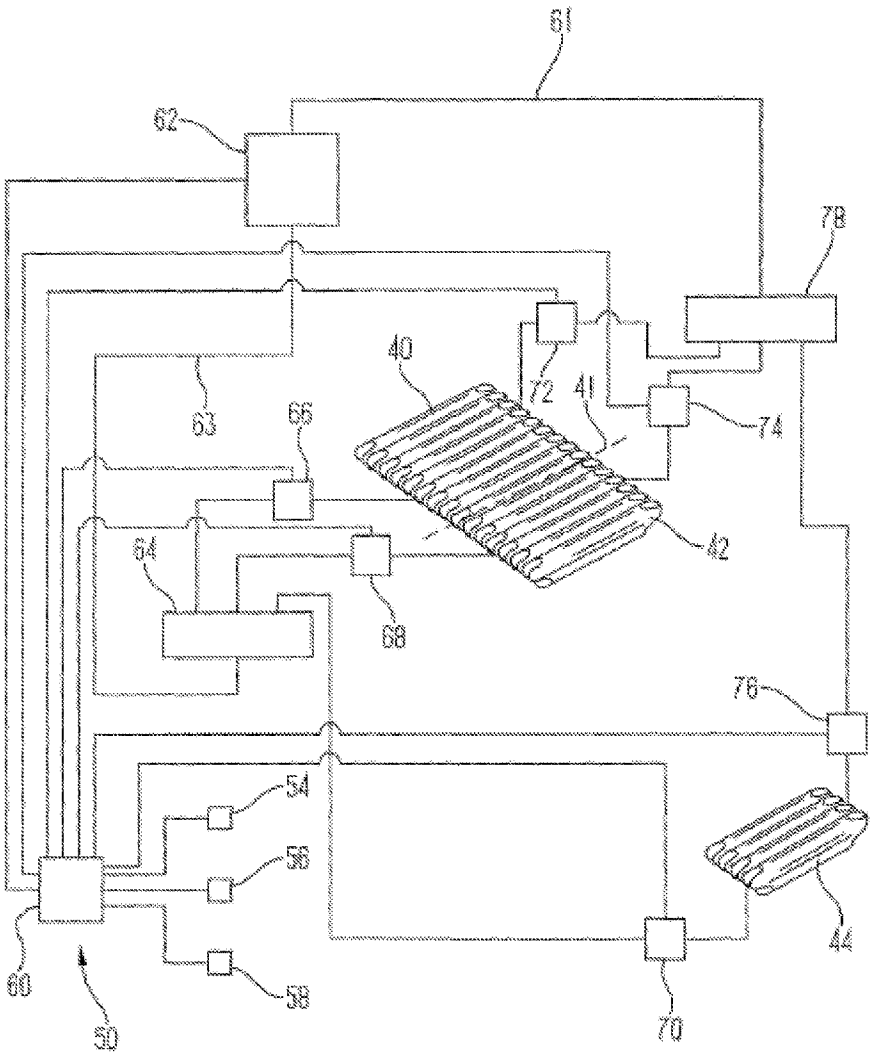
FIG. 2a (Prior Art)
FIG. 2*a* illustrates an exploded view of a portion of FIG. 2, showing a configuration of the pressure control assembly.
Figure 3:
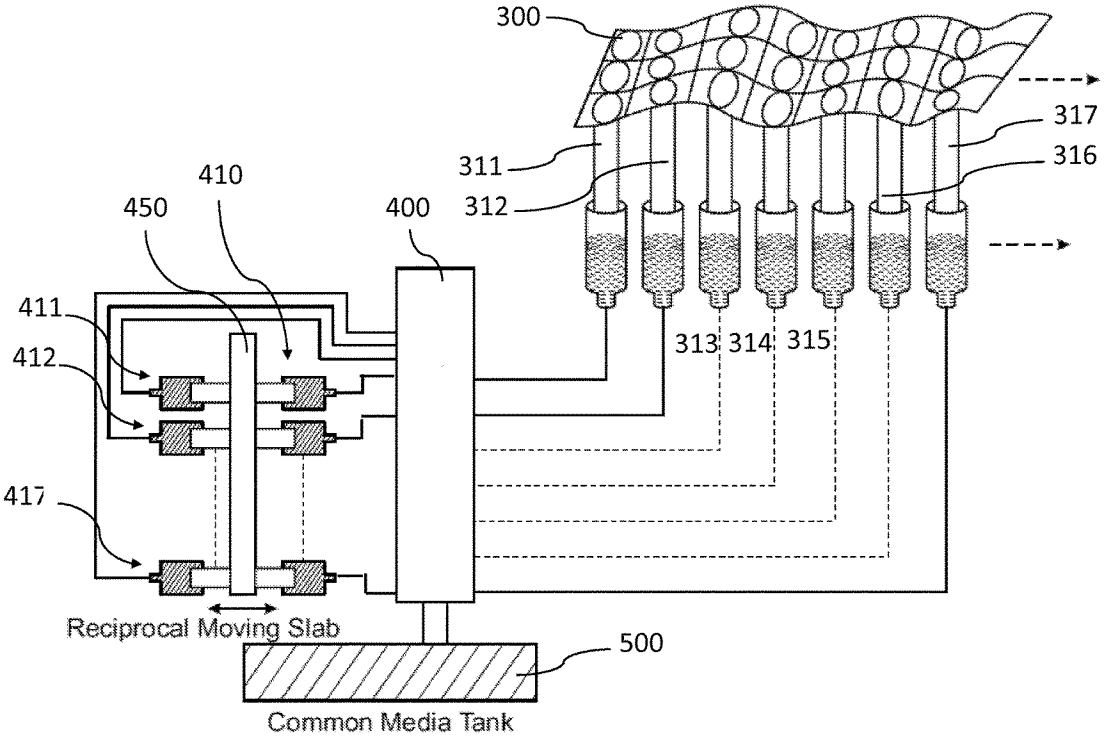
FIG. 3 illustrates a reciprocal three-dimensional surface controller in the present invention.
Figure 4:
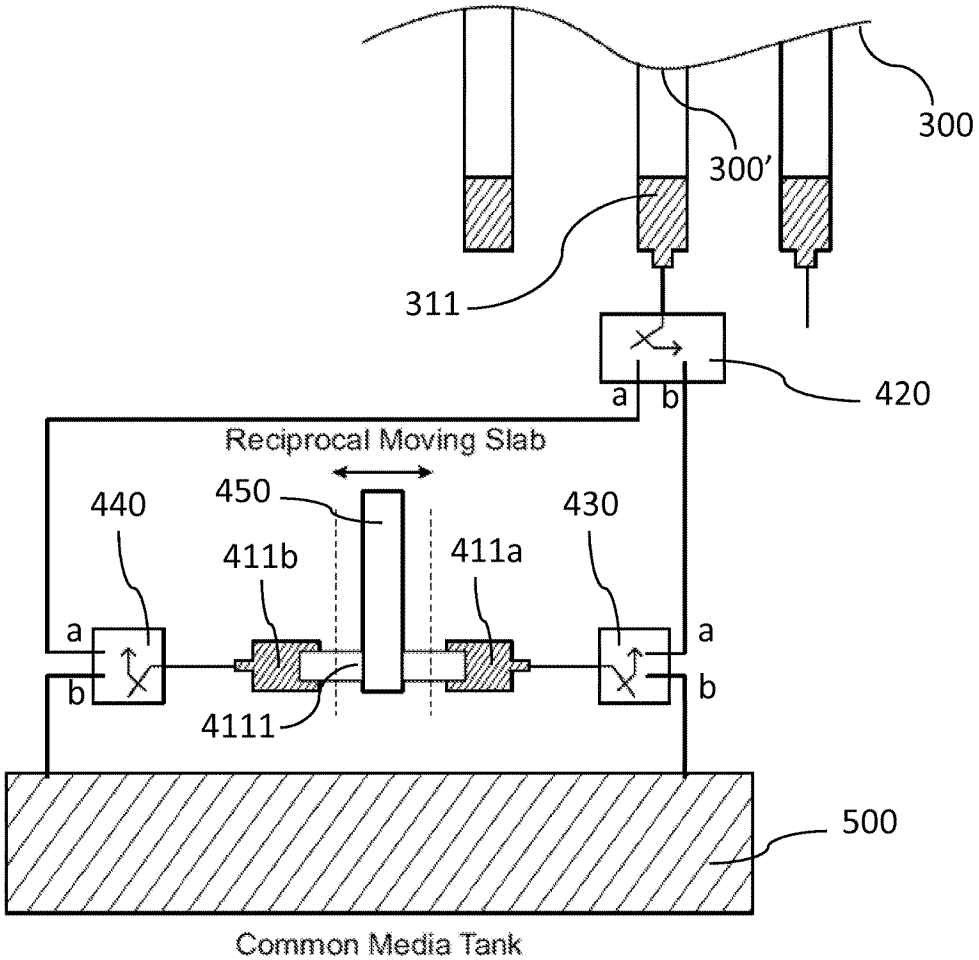
FIG. 4 depicts one embodiment of the reciprocal three-dimensional surface controller in the present invention.

In one aspect shown in FIGS. 3 and 4, a system to generate and control a three-dimensional (3D) surface may include a surface 300 supported by a plurality of actuating units (311, 312, 313 . . . 317, etc.), a control center 400, and a common media tank 500. The control center 400 may include a movement control assembly 410 that has a plurality of movement control unit 411, 412, 413 . . . 417, etc., and each movement control unit is configured to control the movement of a corresponding actuating unit. Details of the control center 400 will be further introduced in FIG. 5. In one embodiment, a predetermined amount of medium, such as air or liquid, is arranged in each actuating unit.

More specifically, taking the movement control unit 411 as an example, the movement control unit 411 may include a driving unit 4111, a first media container 411*a* and a second media container 411*b*. In one embodiment, the first media container 411*a* is connected with the actuating unit 311, while the second media container 411*b* is connected with the control center 400. A reciprocal moving slab (RMS) 450 is disposed nearly at the center of the driving unit 4111 to control the movement thereof and further control the movement of at least a portion of the surface 300 by controlling the medium movement in the actuating unit 311.

In an exemplary embodiment as shown in FIG. 4, the control center 400 may further include a plurality of control vales 420, 430 and 440 to control the medium flow. When the RMS 450 moves toward the first media container 411*a*, the driving unit 4111 is driven to push the medium in the first media container 411*a* to the control valve 430. The medium can be either pushed up to the control valve 420, or to the common media tank 500. For example, when the control valve 430 is at position 430*a*, the medium from the first media container 411*a* can be pushed up to the control valve 420. Meanwhile, if the control valve 420 is at position 420*b*, the movement of the RMS 450 can drive a predetermined amount of medium from the first media container 411*a* all the way to the actuating unit 311 to push up a portion (300') of the surface 300 located on top of the actuating unit 311. It is noted that a conventional system may have to consume a lot of power to control a huge number of actuating units as illustrated in the present invention. However, the power consumption can be significantly reduced by using the RMS 450. Furthermore, the liquid or medium is circulating in the whole closed system, which is very accurate, safe and quiet.

If the first media container 411*a* has been emptied but the portion (300') of the surface 300 still needs to be further pushed up, the RMS 450 can then moves towards the second media container 411*b*. When the control valve 440 is at position 440*a* and the control valve 420 is switched to 420*a*, the medium in the second media container 411*b* can be pushed into the actuating unit 311 to further push up the portion 300' of the surface 300.

In a further embodiment, at least a portion of the surface 300 can be lowered down through the control of the movement of the RMS 450 and the control valves 420 to 440. Still referring to the actuating unit 311 and the portion (300') of the surface 300, when the RMS 450 moves towards the second media container 411*b* (assuming control valve 440 is at position 440*b*), a suction force is created to pull at least a portion of the medium out from the actuating unit 311 to further bring the portion (300') of the surface 300 down. More specifically, when the control valve 420 is at position 420*b* and control valve 430 is at position 430*a*, and the RMS 450 moves towards the second media container 411*b*, the suction force is generated to suck at least a portion of the medium out of the actuating unit 311 through control valves 420*b* and 430*a* to the first media container 411*a* to lower down the portion (300') of the surface 300.

Figure 5:
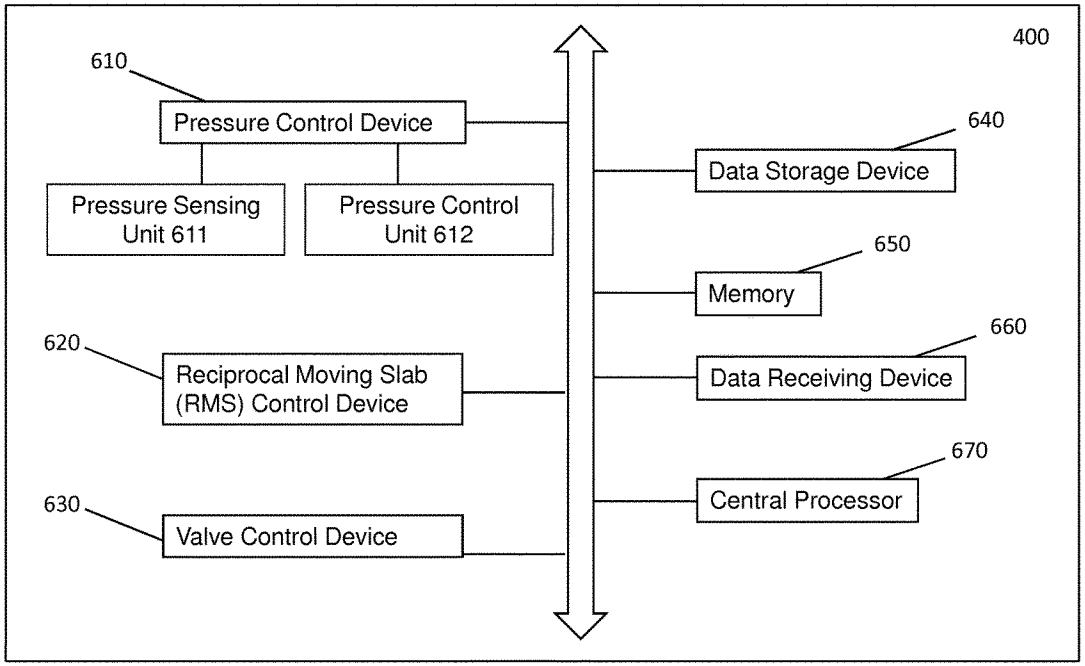
FIG. 5 depicts a block diagram of the control center in the present invention.

In another aspect shown in FIG. 5, the control center 400 may include an pressure control device 610; a reciprocal moving slab (RMS) control device 620 and a valve control device 630. The pressure control device 610 may also include a pressure sensing unit 611 and a pressure control unit 612 in each of the actuating unit. In one embodiment, the pressure sensing unit 611 and pressure control unit 612 can also be arranged and disposed near the control valves (420, 430, 440) to monitor the pressure when the medium is transported. The RMS control device 620 is configured to control the movement of the reciprocal moving slab 450, for example, towards either the first media container 411*a* or the second media container 411*b*. Whether the reciprocal moving slab 450 should move towards the first or second media container can be determined mostly by the desired movement of the surface 300. The amount of the medium in the actuating units, the pressure in the actuating units, the control valves, etc. can also be the factors to affect the movement of the reciprocal moving slab 450.

The valve control device 630 is configured to control the valves such as 420, 430 and 440. The valve control device 630 can receive a command from a central processor 670 regarding the movement of at least a portion of the surface 300, and the valve control device 630 is used to adjust the valve position of each control valve as discussed above to either allow the medium pass through the valve to the actuating unit or direct the medium to the common medium tank 500.

The control center 400 may also include a data storage device 64, a memory 650, a data receiving device 660 and a central processor 670, which may be operatively communicate with the pressure control device 610, the RMB control device 620, the valve control device 630 and the data receiving device 660 to manage and control the movement of at least a portion of the surface 300.

It is important to note that the surface can be controlled and supported by a plurality of actuating units as shown in FIG. 3, and each actuating unit is corresponding to a movement control unit, such as the example of actuating unit 311 and the movement control unit 411 discussed above. Therefore, the control center 400 is configured to control every single piece of the surface 300 that is supported and actuated by each actuating unit, and the movement of surface 300 is contributed by every single small piece thereof through the movement of every single actuating unit that is control by the control center 400. The surface 300 can be actually considered an array of small pieces divided from the surface 300, and supported and actuated by the actuating units. Since the control of the surface 300 is through the control of every single piece thereof, the control of the surface 300 would be more precise if the surface 300 can be divided into more pieces. It is also noted that the system in the present invention can not only be used in "soft" surfaces, such as patient supporting surfaces and air bed surfaces, but also can be used in "hard" surfaces, Namely, the system in the present invention can be used in cast a mold, a bed or a chair with a contour to fit the body.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A system to generate and control a three-dimensional (3D) surface comprising:

a surface;

a plurality of actuating units used to support and control at least a portion of the surface;

a control center; and a common media tank, wherein the control center includes a reciprocal movement slab and a movement control assembly that has a plurality of movement control units, and each movement control unit is configured to control movement of a corresponding actuating unit, and the reciprocal movement slab is configured to drive each of the movement control units to actuate the corresponding actuating units to further control movement of the surface, wherein the movement control unit includes a driving unit, a first media container, and a second media container, and the first media container is connected with the corresponding actuating unit, while the second media container is connected with the control center, and a plurality of control vales are used to control medium flow, wherein when the reciprocal movement slab moves towards the second media container, a suction force is created to pull at least a portion of the medium out from the corresponding actuating unit to further lower down the portion of the surface through the control of one or more control valves.

2. The system to generate and control a three-dimensional (3D) surface of claim 1, wherein a predetermined amount of medium, such as air or liquid, is arranged in each of said actuating units.

3. The system to generate and control a three-dimensional (3D) surface of claim 1, wherein when the reciprocal movement slab moves toward the first media container, the driving unit is driven to push out the medium in the first media container to the corresponding actuating unit to push up a portion of the surface located on top of the actuating unit through the control of one or more control valves.

4. The system to generate and control a three-dimensional (3D) surface of claim 1, wherein common media tank is configured to receive the medium in either the actuating units, the first media container or the second media container when the reciprocal movement slab moves.

5. The system to generate and control a three-dimensional (3D) surface of claim 1, wherein the control center further includes an pressure control device; a reciprocal moving slab (RMS) control device and a valve control device.

6. The system to generate and control a three-dimensional (3D) surface of claim 5, wherein the pressure control device includes a pressure sensing unit and a pressure control unit disposed in each of the actuating unit and near the control valves to monitor the pressure when the medium is transported.

7. The system to generate and control a three-dimensional (3D) surface of claim 5, wherein the RMS control device is configured to control the movement of the reciprocal moving slab.

8. The system to generate and control a three-dimensional (3D) surface of claim 5, wherein the valve control device is configured to control the control valves to either allow the medium pass through the valve to the actuating units or direct the medium to the common medium tank.

9. The system to generate and control a three-dimensional (3D) surface of claim 5, wherein the control center further includes a central processor, which is operatively communicate with the pressure control device, the RMB control device, the valve control device and a data receiving device to manage and control the movement of at least a portion of the surface.

* * * * *